US005966905A

United States Patent [19]

O'Connor et al.

[11] Patent Number: 5,966,905

[45] Date of Patent: Oct. 19, 1999

[54] PACKAGING A STRIP OF MATERIAL IN LAYERS WITH INTERVENING SPLICES

[75] Inventors: Lawrence J. O'Connor; Mark B. Davidson; Darrell Van Mol, all of Winnipeg, Canada

[73] Assignee: Stac-Pac Technologies Inc., Christchurch, Barbados

[21] Appl. No.: 08/948,256

[22] Filed: Oct. 9, 1997

Related U.S. Application Data

[63] Continuation-in-part of application No. 08/889,737, Jul. 8, 1997, which is a continuation-in-part of application No. 08/878,826, Jun. 19, 1997.

[51] Int. Cl.[6] ..... B65B 63/04; B65B 31/00

[52] U.S. Cl. ..... 53/429; 53/434; 53/435; 206/494; 206/524.8; 493/437; 493/357; 493/363

[58] Field of Search ..... 53/429, 116, 117, 53/434, 435, 513, 520, 157; 206/494, 524.8; 493/413, 414, 415, 410, 411, 437, 448, 439, 440, 357, 356, 363

[56] References Cited

U.S. PATENT DOCUMENTS

| | | | |
|---|---|---|---|
| 32,761 | 7/1861 | Elliot . | |
| 1,463,918 | 8/1923 | Borroughs . | |
| 1,985,676 | 12/1934 | Hand . | |
| 3,245,680 | 4/1966 | Harrison et al. | 493/413 |
| 3,351,992 | 11/1967 | Carter | 53/429 |
| 3,673,757 | 7/1972 | Willis | 53/429 |
| 3,684,275 | 8/1972 | Schweitzer et al. | 493/413 X |
| 3,729,367 | 4/1973 | Shore et al. | 53/429 |
| 3,739,544 | 6/1973 | Hanemann . | |
| 4,097,039 | 6/1978 | Fischer | 493/413 |
| 4,201,029 | 5/1980 | Lerner et al. | 53/429 |
| 4,240,854 | 12/1980 | Massey et al. | 53/429 X |
| 4,418,514 | 12/1983 | Spann | 53/434 X |

(List continued on next page.)

FOREIGN PATENT DOCUMENTS

| | | | |
|---|---|---|---|
| B-22983/83 | 3/1986 | Australia . | |
| 47638 | 3/1982 | Japan | 53/116 |
| 2-182666 | 7/1990 | Japan . | |
| 1555205 | 4/1990 | U.S.S.R. | 53/429 |

*Primary Examiner*—Linda Johnson
*Attorney, Agent, or Firm*—Oliff & Berridge, PLC; Adrian D. Battison

[57] ABSTRACT

A package of a continuous strip of material includes a plurality of parallel side by side stacks each containing a length of the strip, which is folded back and forth such that each folded portion of the stack is folded relative to the next portion about a line transverse to the strip and such that the side edges of the strip portions are aligned. The strip is continuous through each stack and can be connected by a splice from the end of one stack to beginning of the next stack. The package is compressed to reduce the height of the stacks and maintained in the compressed condition by an evacuated sealed bag. The package can have the stacks oriented vertically or horizontally. When the stacks are horizontal, the spliced portions are vertical and coplanar with the strips and at alternate ends. When the stacks are vertical, the spliced portions extend from the bottom of the stack along one end of the stack to the top of the next stack. A package can be formed with a tail at the end of each stack ready for splicing, but not yet spliced. Accumulating a twist as the stacks are unfolded is prevented either by pre-twisting the splice portions or by providing the splice portions of alternate stacks at opposed ends of the stacks. The package is formed by the method of folding the strip and securing the folded strip with packaging. The method can further include compressing the folded packaged strip, then vacuum sealing the compressed package.

85 Claims, 10 Drawing Sheets

U.S. PATENT DOCUMENTS

| | | | |
|---|---|---|---|
| 4,427,404 | 1/1984 | Yamada . | |
| 4,499,707 | 2/1985 | Desjobert et al. . | |
| 4,547,184 | 10/1985 | Bunch, Jr. . | |
| 4,597,748 | 7/1986 | Wolf . | |
| 4,603,817 | 8/1986 | O'Connor . | |
| 4,716,706 | 1/1988 | Boeckmann . | |
| 4,896,475 | 1/1990 | McAvinew | 53/117 |
| 4,941,374 | 7/1990 | Focke | 53/157 X |
| 5,064,179 | 11/1991 | Martin . | |
| 5,087,140 | 2/1992 | Keeton et al. . | |
| 5,104,366 | 4/1992 | Bunch | 493/414 X |
| 5,177,934 | 1/1993 | Yamamoto | 53/434 X |
| 5,290,226 | 3/1994 | Green, Jr. . | |
| 5,529,564 | 6/1996 | Hediger . | |

PACKAGING A STRIP OF MATERIAL IN LAYERS WITH INTERVENING SPLICES

This application is a continuation in part application of application Ser. No. 08/889,737 filed Jul. 8, 1997 which is a continuation in part of application Ser. No. 08/878,826 filed Jun. 19, 1997. This application is also related to copending applications Ser. Nos. 08/906,291 filed Aug. 5, 1997 and 08/939,815, 08/939,444 and 08/938,881 all filed Sep. 29, 1997.

This invention relates to a package of a continuous strip of material and to a method for forming a package of a continuous strip of material.

BACKGROUND OF THE INVENTION

Previously packages of a continuous strip of material have been formed using a technique known as "festooning" in which the strip is folded back and forth to lay a series of strip portions back and forth with each portion being folded relative to the next about a line transverse to the strip. The technique of festooning has been available for many years and is used in packaging many different types of material but particularly material of a fibrous nature such as fabric, non-woven strips and the like. In this technique, the strip is conventionally guided into a receptacle such as a cardboard box while a first reciprocating movement causes portions of the strip to be laid across the receptacle and folded back and forth and a second reciprocating movement causes the positions of the portions to be traversed relative to the receptacle transversely to the portions. Normally the receptacle comprises a rigid rectangular container at least partly of cardboard having a base and four upstanding sides.

The purpose of the festooning method is for packaging the strip for supply to a machine using the strip. Some users prefer the festooned package relative to a wound package of this type of material. The festooned package contains a much greater length of material than a spirally wound pad. The festooned package can simply be located adjacent the machine without the necessity for any unwinding or support stand. In addition, both the leading end and the tail end of the package are available at the top of the package so that a series of the package can be connected lead to tail to act as an extended supply. Yet further, since the material is simply laid into the package, there is less problem with tension control in the material as it is withdrawn from the package, in comparison with larger traverse wound packages where tension control of large packages can be a problem due to the inertia of the package thus requiring a driven unwind stand. There is therefore no need when festooned packages are used for a complex unwind stand which takes up more space than may be available and involves significant cost.

Festooned packages are formed in a stiff container or box to properly enclose and contain the material and within which the material is stored during transportation for maintaining the material against compression and distortion due to the transfer of loads from surrounding packages. The cardboard container thus provides support for other similar stacked containers and prevents the transfer of loads from the stacked packages from causing excessive compression of packages at the bottom of a layer. The cardboard containers and the package structures used in the conventional arrangement however have a number of problems.

Firstly the container must be either recycled with the necessity of shipping the cardboard containers in the return direction to the supplier from the end user or they must be discarded, both at considerable expense.

Secondly the cardboard containers simply receive the material without significant compression so that there is wastage of space within the container due to the packaging of air with the material. In addition the conventional package structure does not minimize the amount of air spaces formed in the structure. The transportation costs of the material therefore are significantly increased by the large volume of the material which provides a density which is significantly below the optimum for most efficient transport.

Thirdly the presence of the essential box during formation of the structure provides a restriction to the proper control of the strip as it is laid down since the sides of the box provide limitations to the position and movement of the guide member controlling the strip.

Fourthly it has been noted that the sides of the box which are parallel to the strips as they are laid down do not closely confine the sides of the package structure with the significant danger that the strips can fall down between the edge of the package and the box side.

In addition, the conventional technique for forming the package in which each of the strips slit from a web of supply material is individually packaged at a separate festooning station is slow and requires a large amount of floor space for the large number of stations. Also the large area covered by the stations causes a significant distance to be travelled by the strip from the slitting station to the festooning station with the potential for strip tension problems and damage to the strip.

There remains therefore a significant requirement for a package of this type but the techniques presently available are unsatisfactory for the above reasons leaving opportunity for an improved package structure.

SUMMARY OF THE INVENTION

It is one object of the present invention, therefore, to provide an improved package structure and a method of packaging a strip of material in which the stability of the package can be improved.

According to one aspect of the invention there is provided a package of a strip of material comprising:

a strip of material having a first side edge, a second side edge, a first surface and a second surface;

a plurality of layers of the strip;

each layer comprising a plurality of folded portions of the strip, with each portion of the first layer being folded relative to the next portion about a line transverse to the strip;

the portions of each layer being arranged such that the first surface of each portion lies directly in contact with the first surface of a next adjacent portion, such that the second surface of each portion lies directly in contact with the second surface of a next adjacent portion, such that the first side edges of the portions lie in a first common plane of the layer and such that the second side edges of the portions lie in a second common plane of the layer parallel to the first plane;

the layers being parallel and arranged side by side such that the first and second planes of the each layer are parallel to the first and second planes of each of the other layers, thus defining first and second end layers and a plurality of intermediate layers and defining for each intermediate layer a first next adjacent layer on one side and a second next adjacent layer on an opposed side;

the strip being continuous though each layer from a first end portion of the strip at one end of the layer to a second end portion of the strip at an opposed end of the layer, such that a full extent of the strip from the first end portion to the second end portion can be unfolded from the layer by pulling the strip from either end portion;

one end portion of the strip of the first end layer forming a first end of the package for supply to an end use machine and one end portion of the strip of the second end layer forming a second end of the package for connection to a further package;

the first end portion of the strip of each intermediate layer being connected by a spliced portion to one end portion of the strip of the first next adjacent layer and the second end portion of the strip of each intermediate layer being connected by a spliced portion to one end portion of the second next adjacent layer;

such that the strip is continuous though the package and such that a full extent of the strip from the first end portion of said first end layer to said one end portion of said second end layer can be unfolded for supply to said end use machine.

Preferably the first end portion of the strip of each intermediate layer is connected to the first end portion of the strip of the first next adjacent layer and the second end portion of the strip of each intermediate layer is connected to the second end portion of the second next adjacent layer. Other connections are possible.

Preferably each intermediate layer is connected to the first end portion of the strip of the first next adjacent layer by a first traverse portion extending diagonally between the layers and the second end portion of the strip of each intermediate layer is connected to the second end portion of the second next adjacent layer by a second traverse portion extending diagonally between the layers.

Preferably the first end portion of the strip of each intermediate layer and the first end portion of the strip of the first next adjacent layer are coplanar and the first traverse portion is arranged coplanar therewith and wherein the second end portion of the strip of each intermediate layer and the second end portion of the strip of the first next adjacent layer are coplanar and the second traverse portion is arranged coplanar therewith.

Preferably the portions of the strip in all of the layers are parallel although other arrangements where alternate ones of the layers are rotated through 90 degrees are also possible.

Preferably the layers are coextensive such that the package is rectangular particularly although not necessarily square.

Preferably the connections are arranged such that the first end portion of the strip of each intermediate layer is connected to the first end portion of the strip of the first next adjacent layer by a traverse portion extending diagonally between the layers and the second end portion of the strip of each intermediate layer is connected to the second end portion of the second next adjacent layer by a traverse portion extending diagonally between the layers.

Preferably the connections are effected by splicing after the layers are completed and arranged side by side.

Preferably the package is wrapped by a flexible packaging material such that the layers are held together by pressure from the packaging material.

Preferably the package is wrapped by a flexible packaging material which is sealed and under vacuum such that the layers are maintained in a compressed condition in a direction at right angles to the surfaces of the portions of the strip by pressure from the packaging material.

Preferably the packaging material is dimensioned such that the packaging material expands when the vacuum is released to release the pressure on the layers.

Preferably the layers are horizontal such that loads from upper layers are transferred to lower layers through edges of the strip and there is provided a horizontal pallet for supporting the layers.

Preferably the number of layers is an even number and the end portion of the strip of the first end layer forming a first end of the package for supply to an end use machine and the end portion of the strip of the second end layer forming a second end of the package for connection to a further package are both arranged at the same side of the package.

Preferably the portions are folded so that some of the transverse lines forming the folds are offset from others in a direction longitudinal of the portions.

According to a second aspect of the invention there is provided a method of forming a package of a continuous strip of material comprising:

forming a plurality of layers each containing a strip of the material;

each layer comprising a plurality of folded portions of the strip, with each portion of the layer being folded relative to the next portion of the layer about a line transverse to the strip;

the portions of each layer being folded such that the first surface of each portion lies directly in contact with the first surface of a next adjacent portion, such that the second surface of each portion lies directly in contact with the second surface of a next adjacent portion, such that the first side edges of the portions of the layer lie in a first common plane of the layer and such that the second side edges of the portions of the layer lie in a second common plane of the layer parallel to the first plane;

the strip being continuous though each layer from a first end portion of the strip at one end of the layer to a second end portion of the strip at an opposed end of the layer, such that a full extent of the strip from the first end portion to the second end portion can be unfolded from the layer by pulling the strip from either end portion;

the strip of each layer being separate from the strip of other layers;

arranging the layers side by side with the first and second common planes of each layer parallel to the first and second common planes of other layers to define first and second end layers of the package and a plurality of intermediate layers and to define for each intermediate layer a first next adjacent layer on one side and a second next adjacent layer on an opposed side;

splicing the first end portion of the strip of each intermediate layer to one of the first and second end portions of the strip of the first next adjacent layer;

and splicing the second end portion of the strip of each intermediate layer to one of the first and second end portions of the second next adjacent layer;

such that one end of the strip of the first end layer forms a leading end of the package and one end of the strip of the second end layer forms a trailing end of the package and such that the strip is continuous though the package.

According to a third aspect of the invention there is provided a package structure which is arranged ready for splicing but in which the splicing has not yet been completed, the package comprising:

a strip of material having a first side edge, a second side edge, a first surface and a second surface;

a plurality of layers of the strip;

each layer comprising a plurality of folded portions of the strip, with each portion of the layer being folded relative to the next portion about a line transverse to the strip;

the portions of each layer being arranged:

such that the first surface of each portion lies directly in contact with the first surface of a next adjacent portion;

such that the second surface of each portion lies directly in contact with the second surface of a next adjacent portion;

such that the first side edges of the portions are aligned with a first set of common first lines at right angles to the portions containing the first side edges of the layer;

and such that the second side edges of the portions are aligned with a second set of common second lines at right angles to the portions containing the second side edges of the layer, the first set of lines being parallel to the second set of lines;

the layers being parallel and arranged side by side thus defining first and second end layers and a plurality of intermediate layers and defining for each intermediate layer a first next adjacent layer on one side and a second next adjacent layer on an opposed side;

the layers being oriented such that the second end portions are horizontal and at a bottom of the layer and the first end portions are horizontal and at a top of the layer and such that the fold lines of the layers lie substantially in two planes defining sides of the package and such that the bottom layers define a bottom of the package and the top layers define a top of the package;

the strip being continuous through each layer from a first end portion of the strip at one end of the layer to a second end portion of the strip at an opposed end of the layer, such that a full extent of the strip from the first end portion to the second end portion can be unfolded from the layer by pulling the strip from the first end portion;

the second end portion of each layer including a tail portion extending from the bottom of the layer upwardly along a side of the package to the top of the package for splicing to the first end portion of the next adjacent layer or to a next package.

One embodiment of the invention will now be described in conjunction with the accompanying drawings in which;

BRIEF DESCRIPTION OF THE DRAWINGS

In the drawings like characters of reference indicate corresponding parts in the different figures.

DETAILED DESCRIPTION

As will be clear from the description of the following embodiments, the terms "layer", "stack", "end", "side", "top" and "bottom", as used herein, are not intended to limit the invention so described to any particular orientation. It will be fully clear that the package can be rotated to any desired orientation during formation, transportation, storage, and/or unfolding and will remain unchanged by that rotation. The terms are used herein to assist the reader in visualizing the package and assist in providing consistency in terminology.

As shown in FIGS. 1 to 4, the package comprises a generally rectangular body 10 formed from a strip or sheet 11 of a pliable material to be packaged and generally this material will be of a fibrous nature formed by woven or non-woven material although this is not essential to the package structure. Many materials of various thicknesses can be packaged using the festooning technique provided they can accept the creasing necessary at the end of each portion.

Figure 2:
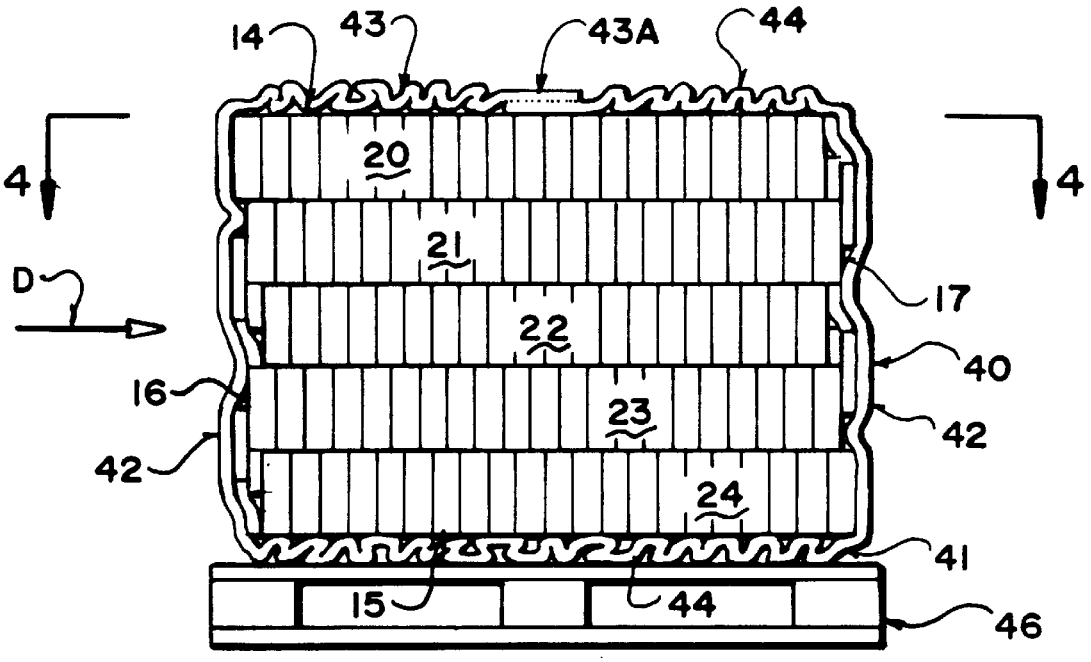
FIG. 2 is a cross sectional view along the lines 2—2 of FIG. 1, with the flexible packaging material and a pallet included and the package rotated to its normal transportation position with the layers horizontal.
Figure 3:
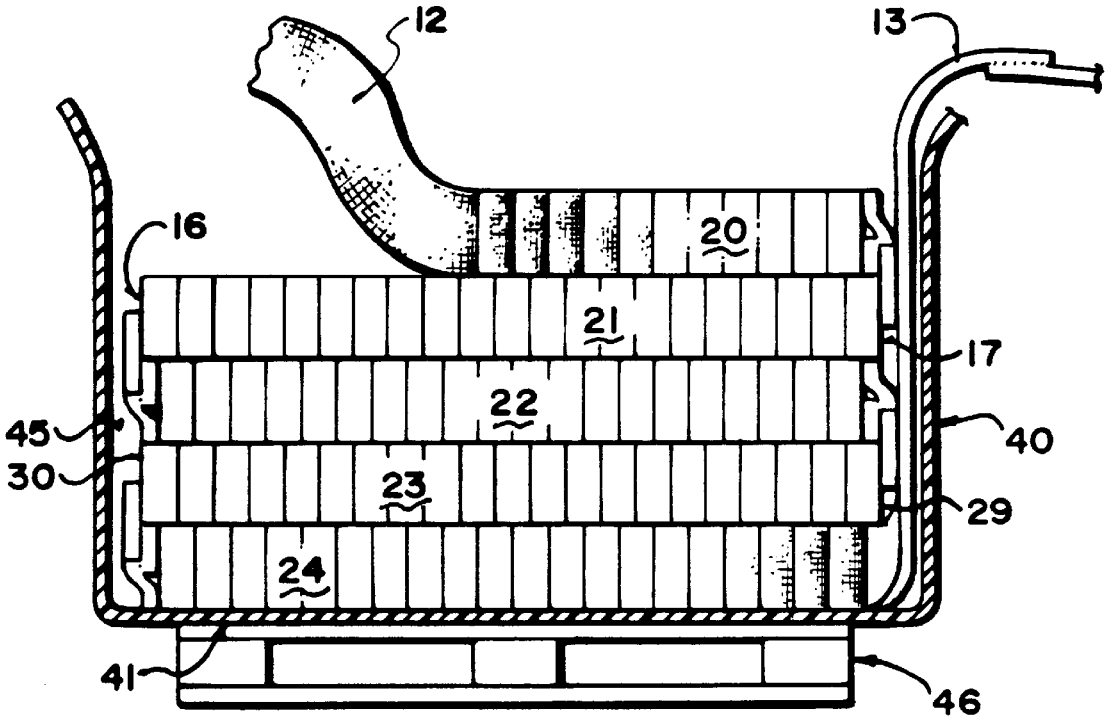
FIG. 3 is a cross sectional view similar to that of FIG. 2 showing the package opened and the strip partly withdrawn.
Figure 4:
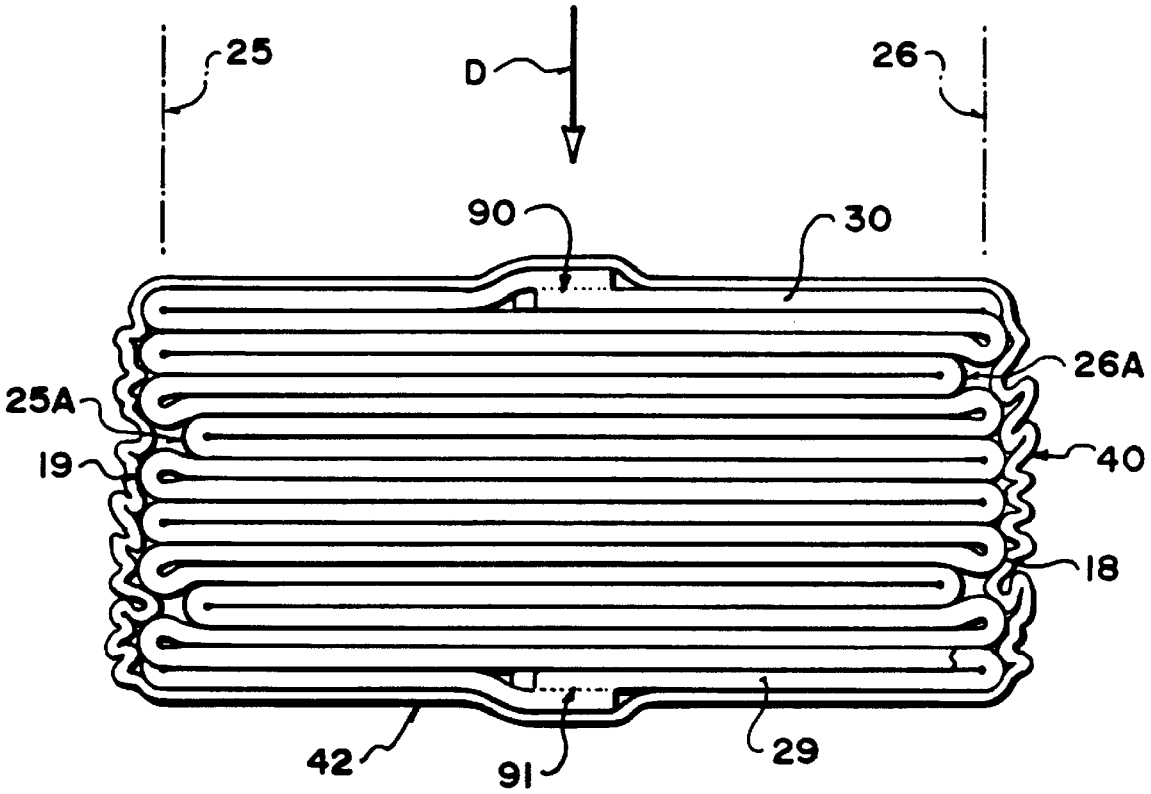
FIG. 4 is a cross sectional view along the lines 4—4 of FIG. 2.

The strip has a leading end 12 and a trailing end 13 of the package and otherwise is substantially continuous through the package. The package when oriented in its normal position for transportation or use as shown in FIGS. 2, 3 and 4 has a top 14, a bottom 15, two sides 16 and 17 and two ends 18 and 19.

The package is formed by a plurality of layers of strips also sometimes called stacks herein. In the embodiments shown in FIGS. 1 to 4, there are five layers of the strip indicated respectively at 20, 21, 22, 23 and 24. The layers are parallel and an outer side of the layer 20 forms the top surface 14 of the package and an outer side of the layer 24 forms the bottom surface 15 of the package if the package is oriented with the stacks lying horizontally. Of course, if the stacks are oriented vertically, the surfaces 14 and 15 would be the sides of the package. The package thus has end layers 20 and 24 and a plurality (in this embodiment three) of intermediate layers.

It will be appreciated that the dimensions of the package can of course be varied in accordance with the requirement so that the number of layers, the length of each layer and the height of each layer can be varied and in FIGS. 6 to 10, the package is shown as having eight layers.

Figure 1:
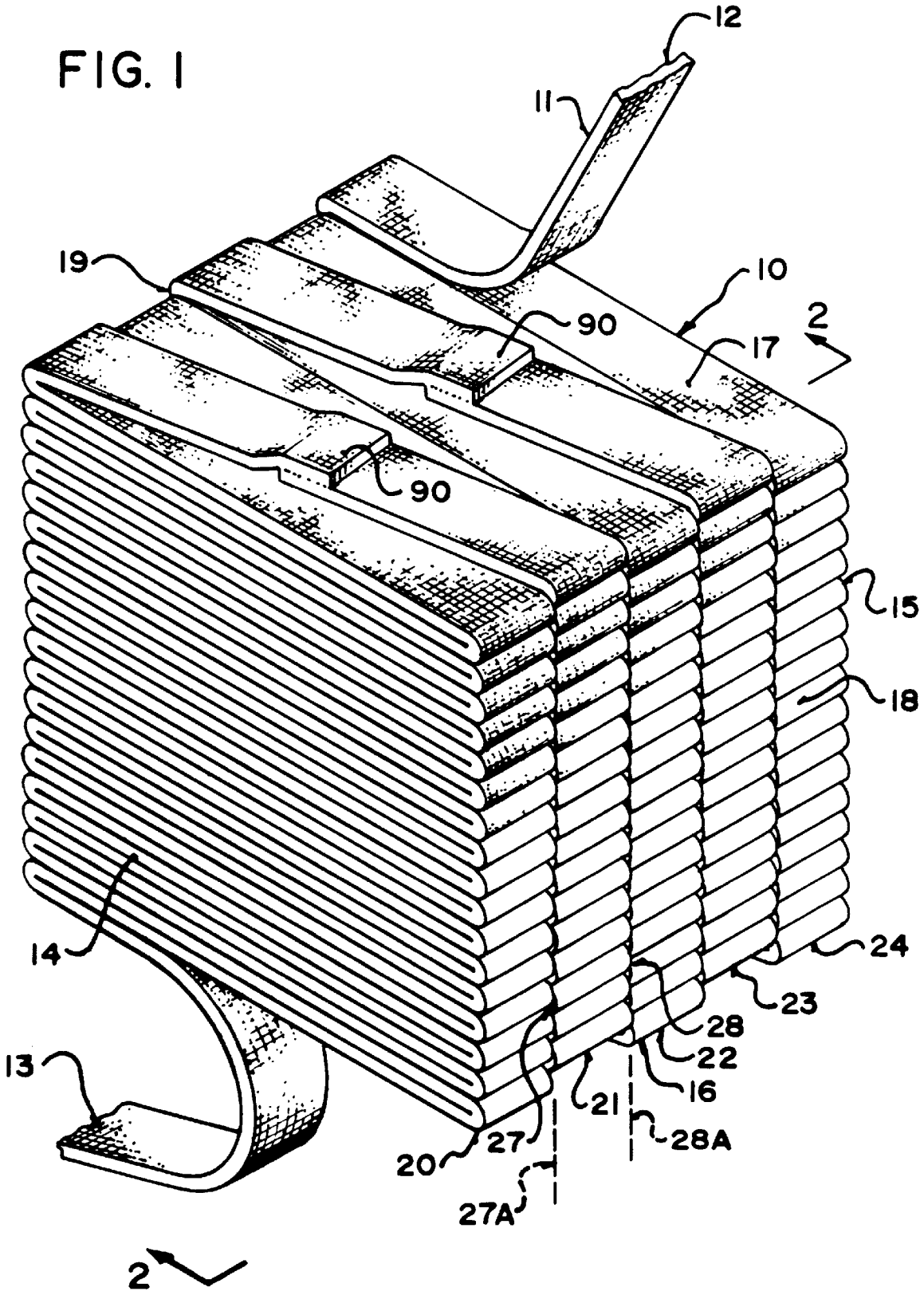
FIG. 1 is a schematic isometric view of a package of a continuous strip according to the present invention, the package including five layers of the strip and being shown with the flexible packaging material omitted for convenience of illustration.

Each layer of the strip comprises a plurality of portions of the strip which are laid on top of one another. Thus as shown in FIG. 4 the portions are folded back and forth to form accordion folded sheets at respective end fold lines 25 and 26 so that the fold lines lie in a common vertical plane defining the ends 18 and 19 of the package. Each portion of the strip lies directly on top of the previous portion so that, with the strip being of constant width as shown, the side edges 27 and 28 of the portions of the strip lie in common vertical planes 27A, 28A as shown in FIG. 1. In other words, the side edges 27 of the strips of the layers are aligned and define a first set of lines in the common plane 27A at right angles to the strip portions which contain all the side edges 27 of the layer and similarly, the side edges 28 of the strips of the layers define a second set of lines in the common plane 28A at right angles to the strip portions which contain all the side edges 28 of the layer.

Thus the package is formed by laying the portions each on top of the next from a bottom portion 29 up to a top portion 30 to form the layer. The package is thus formed from the plurality of layers each of which has a length equal to that of the other layers and therefore equal to that of the package and the layers are formed up to a common height which is therefore equal to the height of the package.

The package is wrapped by a flexible packaging material preferably of heat sealable non-permeable plastics which encompasses the whole of the package as indicated at 40. The packaging material includes a base 41 and sides 42 with a top 43 wrapped over the top of the package and heat sealed as indicated at 43A. The sealed package allows air to be extracted from the package and this vacuum action can be used with physical compression from the sides 16 and 17 of the package so as to compress the package to a reduced height in a vacuum packaging system. The amount of compression can be determined so as to minimize the volume of the package without interfering with the required loft of the product when withdrawn from the package. In this way the package structure avoids the necessity for rigid sides of a box or similar container so the package structure is stable due to the compression of the layers to reduce the height of the layers and due to the pressure of each layer against the sides of the next adjacent layers.

Compression of the package is only possible in the direction D which is at right angles to the surfaces of the portions of the strip. This acts to compress the thickness of the portions so that the dimension of each layer in the direction D is reduced by that compression. Compression along the portions or at right angles to the layers is not possible since this will act to distort the strip. Mechanical compression therefore of the package in the direction D thus reduces the dimension of the package in that direction allowing the air to be withdrawn from the flexible packaging material 40 causing the packaging material to be pulled down onto the package to maintain it in its compressed condition and to apply pressures tending to hold the layers in intimate contact.

In the rest condition of the packaging material as shown in FIG. 3, the base 41 of the packaging material 40 is shaped and dimensioned so as to be slightly larger than the rest or uncompressed condition of the package structure itself. In this way the package structure can be readily inserted into the formed plastics packaging material and can remain in place loosely held by the packaging material. During transportation and storage the package structure is in the compressed and vacuumed condition. In this condition the base 41 of the packaging material and the top 43 of the packaging material are both compressed in the direction D so as to form wrinkles or creases 44. When the vacuum is released, however, the expansion of the package from its compressed condition to its normal relaxed condition will cause the creases 44 to be extracted as shown in FIG. 3. Also, in the expanded condition of FIG. 3, there is a slight space 45 between the sides 42 of the packaging material and the sides 16 and 17 of the package structure allowing the strip to be pulled in the unwrapping process from the ends of the layers without compressing or distorting the end portions 29 and 30.

When wrapped, compressed, sealed and mounted on a transportation pallet 46, the package structure in FIGS. 2 and 3 is oriented so that the layers are horizontal. In this orientation, the application of vertical loads onto the package from other packages causes the transfer through the package structure to the pallet 46 without distorting or damaging the strip. This occurs due to the fact that the strip is relatively stiff across its width and when compressed into the layers, the strips together form a substantially rigid structure.

This orientation of the package used for unwinding the package is shown in FIG. 3. Thus in FIG. 3 a partial unwinding of the structure is shown in that the top 43 is opened and the leading end 12 of the strip is found and pulled through the opening. By placing the package in this orientation, therefore, each layer in turn can be unwound without the danger of the layer toppling since it is lying on its side supported by the underlying layers.

Each layer is connected to the next by a traverse portion of the strip which extends from one layer to the next. Thus the intermediate layers are each connected so that one end of the strip of that layer is connected to the next adjacent layer on one side and the other end of the strip of that layer is connected to the next adjacent layer on the opposite side. A technique for connecting the strip of each layer to the next layer is shown and described in more detail hereinafter.

As shown in FIG. 4, some of the transverse fold lines can be offset from all or some of the others in a direction longitudinal of the portions. Thus the fold lines 25A are offset inwardly from the plane 25 at one end and the fold lines 26A are similarly offset from the plane 26. This technique can be used to prevent build-up at the ends of the package when the material being packaged is resistant to folding leaving a fold of increased height.

Figure 5:
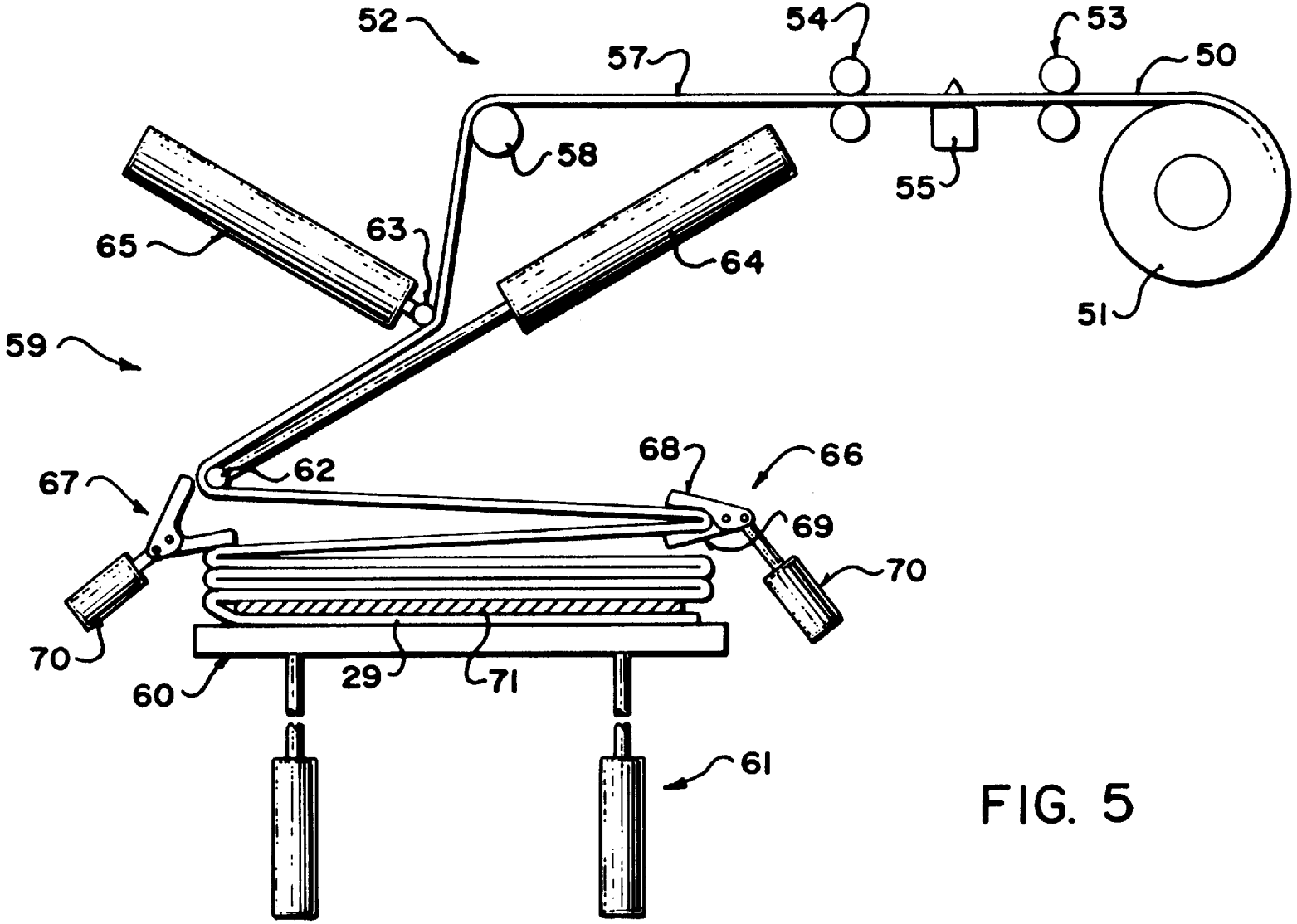
FIG. 5 is an end elevational view of an apparatus and method for forming the package of FIG. 1.
Figure 6:
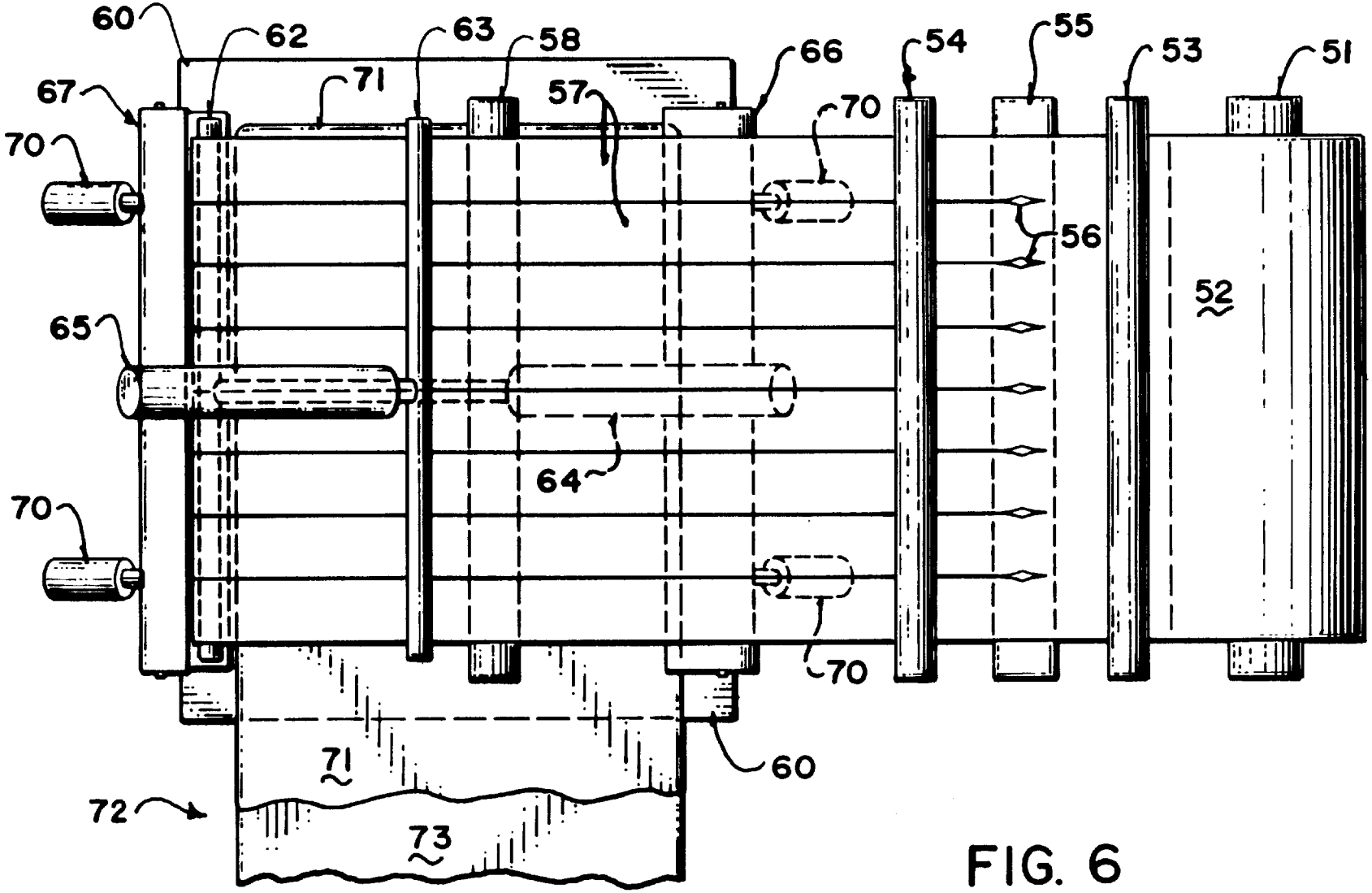
FIG. 6 is a top plan view of the apparatus of FIG. 5.

Turning now to FIGS. 5 and 6, a technique for forming the package structure is shown in more detail. A web 50 is supplied on a master roll 51 and is unwound from the master roll by a feeding and guide system 52 including two nip roller pairs 53 and 54. A slitter bar 55 is mounted transversely to the web and carries a plurality of slitter knives 56 at transversely spaced positions so as to slit the web into a plurality of strips 57 which are carried forwardly by the guide system 52 so that they are maintained in the common plane of the web and are maintained edge to edge. Thus the strips are in effect maintained in the form of a web without any deviation which could cause tension changes. The coplanar strips 57 are fed over a guide roller 58 into a folding system generally indicated at 59 located underneath the feed roller 58.

The folding system 59 comprises a support table 60 having a width sufficient to receive the full width of the web 50, that is the strips in side by side arrangement. The support table 60 has a length sufficient to receive the portions of the folded strips in the structure as previously described. The table 60 is mounted upon a jacking system 61 which is shown only schematically and acts to raise and lower the table so that the table is gradually lowered as the strips are folded onto the table.

The folding system further includes a pair of folding bars 62 and 63 which act to fold the strips back and forth across the table 60. The folding bar 62 is mounted on an actuating cylinder 64 and similarly the folding bar 63 is mounted on an actuating cylinder 65. In FIG. 5, the folding bar 63 is shown in the retracted position and the folding bar 62 is shown in the extended position. The folding bars move alternately between these positions so that the folding bar 62 is firstly retracted and then the folding bar 63 is extended so as to move the strips across the table to form the overlying portions of the strip previously described. The folding bars 62 and 63 extend across the full width of the web so as to engage all of the strips simultaneously and to move those strips simultaneously into the folded positions. The strips thus remain in parallel edge to edge position as they are being folded. The folding bars 62 and 63 may be in the form of rollers to allow the material to pass over the bar without friction while the material is being pushed by the bar to the required position on the table. The mounting system for supporting the cylinders is not shown for convenience of illustration and this will of course be well apparent to one skilled in the art.

The folding system further includes a pair of creasing jaws 66 and 67 each arranged at the end of the stroke of a respective one of the folding bars. The creasing jaws also extend across the full width of the web and comprise a pair of jaw elements 68 and 69 which can be moved from an open position as indicated on the left and a closed creasing position as indicated on the right. The jaws are moved between these positions by an actuating cylinder 70 timed in relation to the operation of the cylinder 64 and 65. In addition to the opening and closing movement, the creasing jaws also move inwardly and outwardly in a horizontal direction relative to the table so as to release each fold or crease line after it is formed to allow that layer and the fold at the end of the layer to be dropped onto the previous layers and to move downwardly with the table 60. Thus as illustrated, the creasing jaw 66 at the completion of the crease moves outwardly away from the crease or fold line and at the same time opens slightly to release the fold between the two portions to drop downwardly onto the underlying portions. The jaws then open and move back inwardly ready to receive the portion of the strips wrapped around the folding bar and to grasp those as they are released from the folding bar as shown at the creasing jaw 67 in FIG. 5. This compound motion can be effected by suitable mechanical linkage operated by the actuating cylinder 70, this arrangement again being well apparent to one skilled in this art.

The strips are therefore simultaneously laid down in portions folded back and forth on top of one another to simultaneously form a plurality of the layers of the package structure. Each layer is thus formed by a single respective one of the strips. The strip is continuous throughout the layer. In order to provide a continuous strip, one or more master rolls may be spliced into the supply with the splice being formed across the width of the web so that each slit strip also acts to slit through the splice.

The back and forth folding of the strips into the layers is continued until sufficient of the portions are applied to the layer to complete the layer in accordance with the required dimensions of the layer.

As shown in FIG. 5, a bottom clamping plate 71 of a clamping system is generally indicated at 72. The clamping system comprises the bottom plate 71 and a top plate 73. The clamping plates are movable by an actuation system schematically indicated at 74. The clamping plates 71 and 73 are parallel and initially horizontal so that they can be inserted between the portions of the strips across the full width of the web.

The actuation system 74 provides complex movement of the clamping plates. Thus the clamping plates can be extended and retracted in a longitudinal direction independently of one another. The clamping plates can be moved together to reduce the spacing therebetween while remaining parallel in a clamping action so as to squeeze the portions of the web between the clamping plates. The clamping plates can be rotated about a central horizontal axis through 90° and 180° so as to rotate the package structure to present different surfaces at the top. The clamping plates can be translated from a position on top of the table 60 to a separate location for depositing the package structure onto the pallet 46, if this is used in transportation.

The bottom clamping plate 71 is inserted on top of the lowermost portion 29 so that the lower most portion lies underneath the clamping plate and is therefore exposed when the clamping plate and the package are removed from the table 60. In the formation of the package, therefore, the clamping plate 71 is extended into position on top of the table after the lowermost portion 29 is laid, following which the further portions are laid on top of the clamping plate 71.

Figure 7:
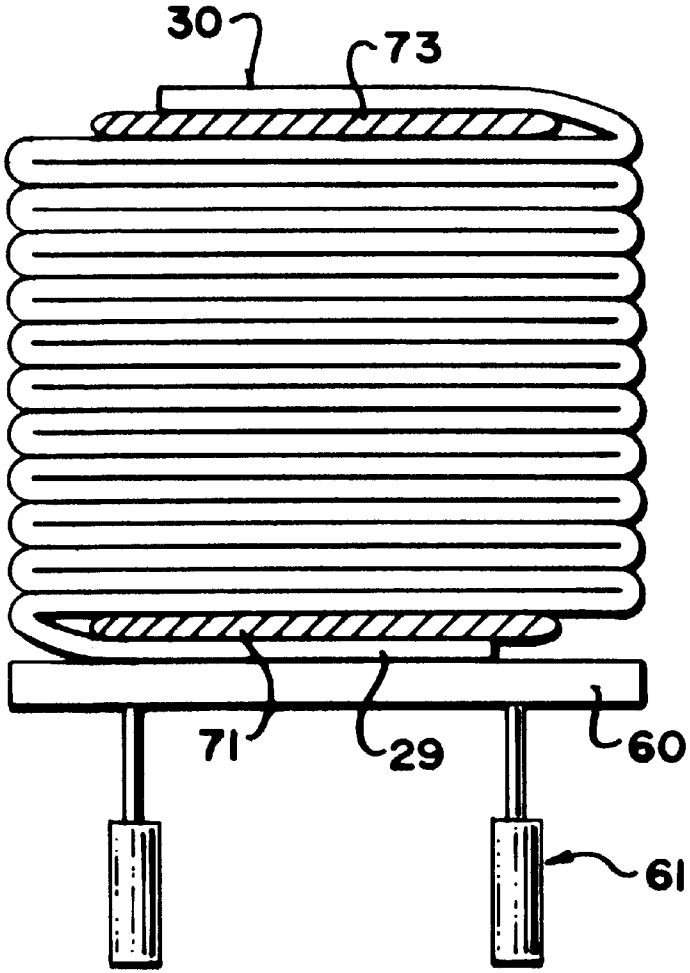
FIG. 7 is a side elevational view of the apparatus similar to that of FIG. 5 showing the top clamping plate moved into position after completion of the required number of portions in each layer, the folding bars and the creasing jaws being omitted for convenience of illustration.

Symmetrically the top clamping plate 73 is moved into position, as shown in FIG. 7, when the number of portions in the layer is complete and immediately prior to the laying of the last portion 30. Therefore again, the last portion 30 is exposed when the clamping system including the clamping plate 71 and 73 and the package are removed from the table 60.

After the folding action is therefore complete, the clamping action is effected by extension of the top clamping plate 73 and by a clamping movement squeezing the clamping plates together. When this is completed, the package structure can be removed from the table 60 for the further completing actions as described hereinafter and the folding of a further package structure can be recommenced using a second clamping system independent of the first.

Figure 8:
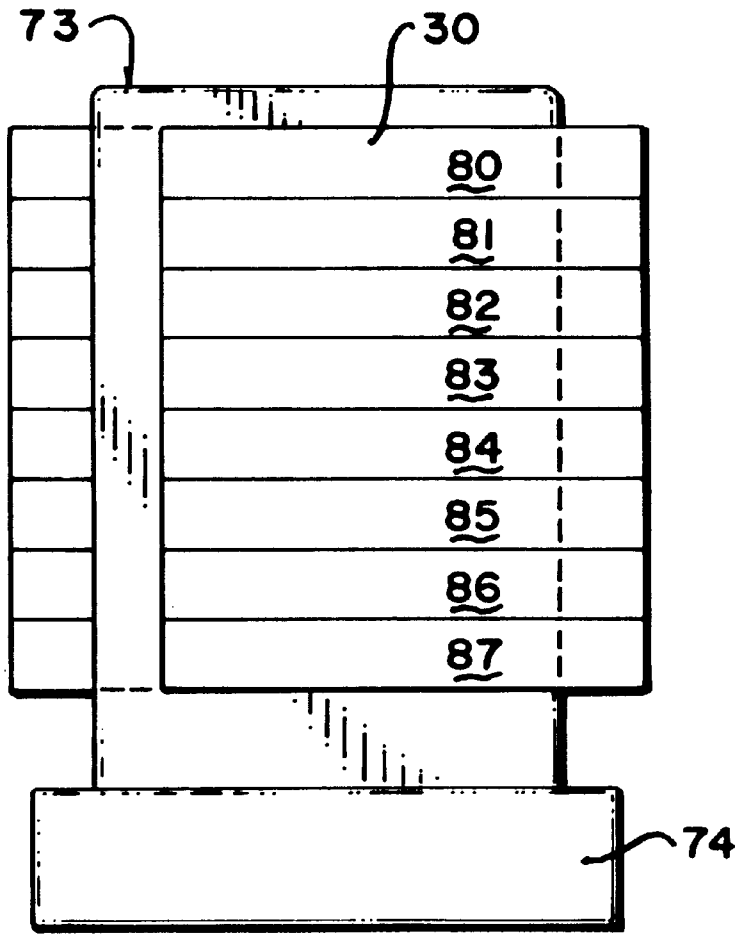
FIG. 8 is a top plan view of the elements of the apparatus as shown in FIG. 7 after removal of the clamped layers from the folding system.

It will be appreciated that in the stage as shown in FIG. 8 in which the package structure is removed from the table 60, each of the layers is separate from and independent of the other layers since each is formed by a respective one of the strips slit from the web 50. Thus in FIG. 8 there are shown eight layers 80 through 87 arranged side by side with the sides edges of the layers in contact as previously described in relation to the package structure shown in FIGS. 1 through 4.

Figure 10:
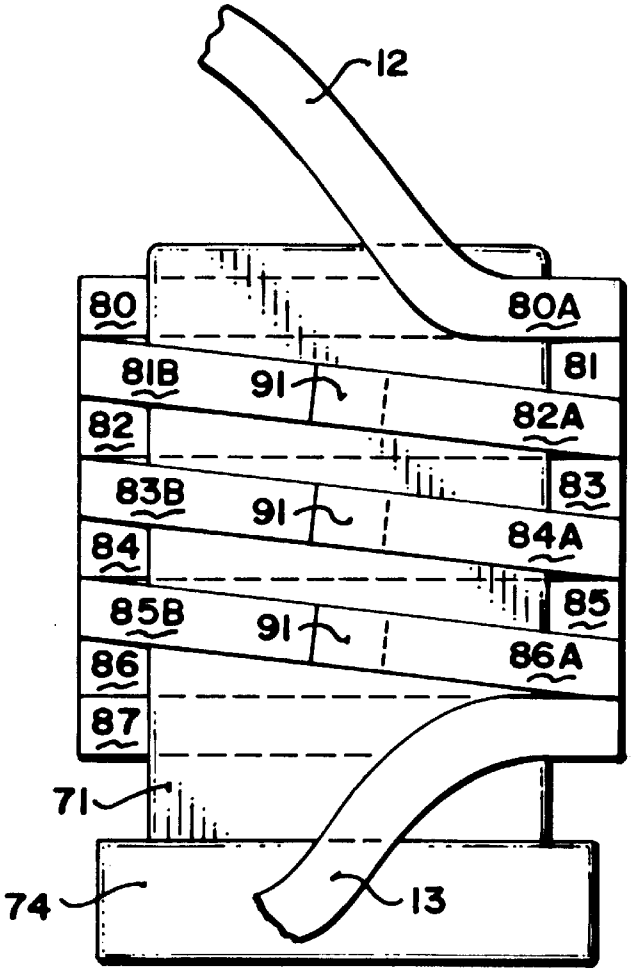
FIG. 10 is a bottom plan view of the elements of the apparatus as shown in FIG. 8 after completion of the splices in the strip between the layers and showing the free ends of the strip at the end layers of the package.
Figure 9:
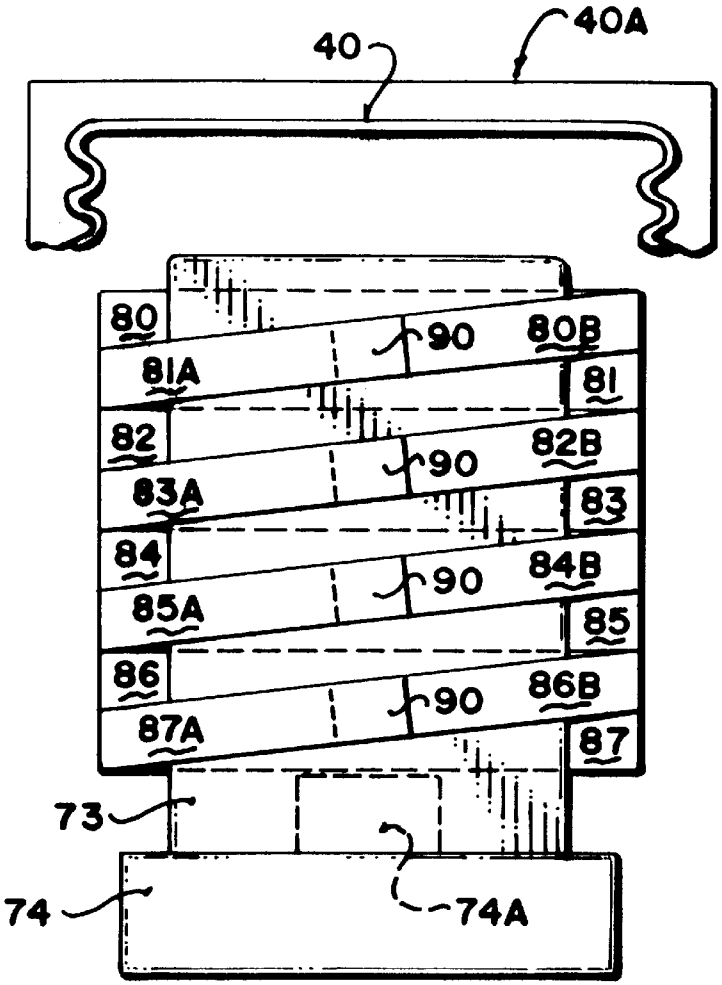
FIG. 9 is a top plan view of the elements of the apparatus as shown in FIG. 8 after completion of the splices in the strip between the layers.

Turning now to FIGS. 9 and 10, the technique for interconnecting the layers is shown. FIG. 9 shows the package structure in the orientation of FIG. 8. FIG. 10 shows the package after it has been inverted or rotated through 180° about the central axis of the clamping system.

Thus it will be noted that one end 80A of the layer 80 forms the leading end 12 of the package. As shown in FIG. 9 a second end 80B of the layer 80 is spliced by a splice 90 to a leading end 81A of the layer 81.

The opposite end 81B of the layer 81 is spliced by a splice 91 to a leading end 82A of the layer 82. As shown in FIG.

9 the trailing end 82B of the layer 80 is spliced to the leading end 83A of the layer 83 by a splice 90.

In a symmetrical manner, as shown in FIG. 9 the trailing end 84B of the layer 84 is spliced to the leading end 85A of the layer 85 by a splice 90. In addition a further splice 90 interconnects the trailing end 86B of layer 86 and the leading end 87A of the layer 87.

As shown in FIG. 10, two further splices 91 are formed between the trailing end 83B of layer 83 and the leading end 84A of the layer 84, and between the trailing end 85B of a layer 85 and the leading end 86A of the layer 86.

The splices 90 are all formed on top of the top clamping plate 73 using the clamping plate as a support base for effecting a strong seal which in some cases may be usable in the end use machine without the necessity for cutting out the splice. Since the splice is formed while the package is stationary, it can be formed using careful technique such as stitching or heat sealing depending upon the materials involved. In this way the splice can be made as effective as possible so as to minimize the inconvenience of a splice in subsequent processing. Various techniques for splicing are available depending upon the type of material to be spliced.

The splice portions are co-planar with the end portions of the strip and thus lie flat against the side of the package when completed and wrapped as described herein.

After the package is inverted as shown in FIG. 10, the splices 91 can be formed on top of the bottom plate 71 which is now at the top, again using that plate as a support base.

It will be noted from FIGS. 9 and 10 that the spliced portions extend diagonally from one layer to the next. In order to achieve this arrangement from the construction shown in FIG. 8, it is necessary to pull a part of the strip from underneath the top plate 73 at the layers 81, 83, 85 and 87 and to connect that pulled portion to the exposed portion of the strip at the layers 80, 82, 84 and 86. In most cases this necessitates cutting of an extra exposed piece as waste leaving a direct connection forming the diagonally extending spliced portion, such as that defined by the ends 81A and 80B connected by the splice 90.

It will be noted that the splicing technique shown ensures that the strip is spliced with a first surface of the strip from one layer connected to the first surface of the strip on the next layer and the second surface connected to the second surface. In addition, when the strips are unwrapped as shown in FIG. 3, no twist is applied to the strip as the unwrapping transfers from one layer to the next.

After the splices are complete, the package is inserted into the bag 40 supported in a vacuum packing system schematically indicated at 40A. The bag is dimensioned as previously described so that the insertion of the package into the bag can be effected without difficulty. Once inserted into the bag, the clamping plates 71 and 73 are retracted by the actuation system 74 using a push rod 74A to push the package away from the clamping plates so that the package is released from the clamping plates and deposited into the bag 40. When placed into the bag or wrapping material, the vacuum sealing system 40A is operated to complete the compression of the package and the sealing of the vacuum packing material 40 as previously described.

In an alternative technique for forming the package in which the package is completed in place on the table, the bottom splices are formed in place on the table before the layers are stacked on top of the splices. The top splices are then completed at the top of the layers and the package wrapped as described above. Folding can in some cases continue on a second table while the package is finished at the first table. This technique reduces the handling of the package while it is unwrapped thus reducing the possibility of damage.

Figure 11:
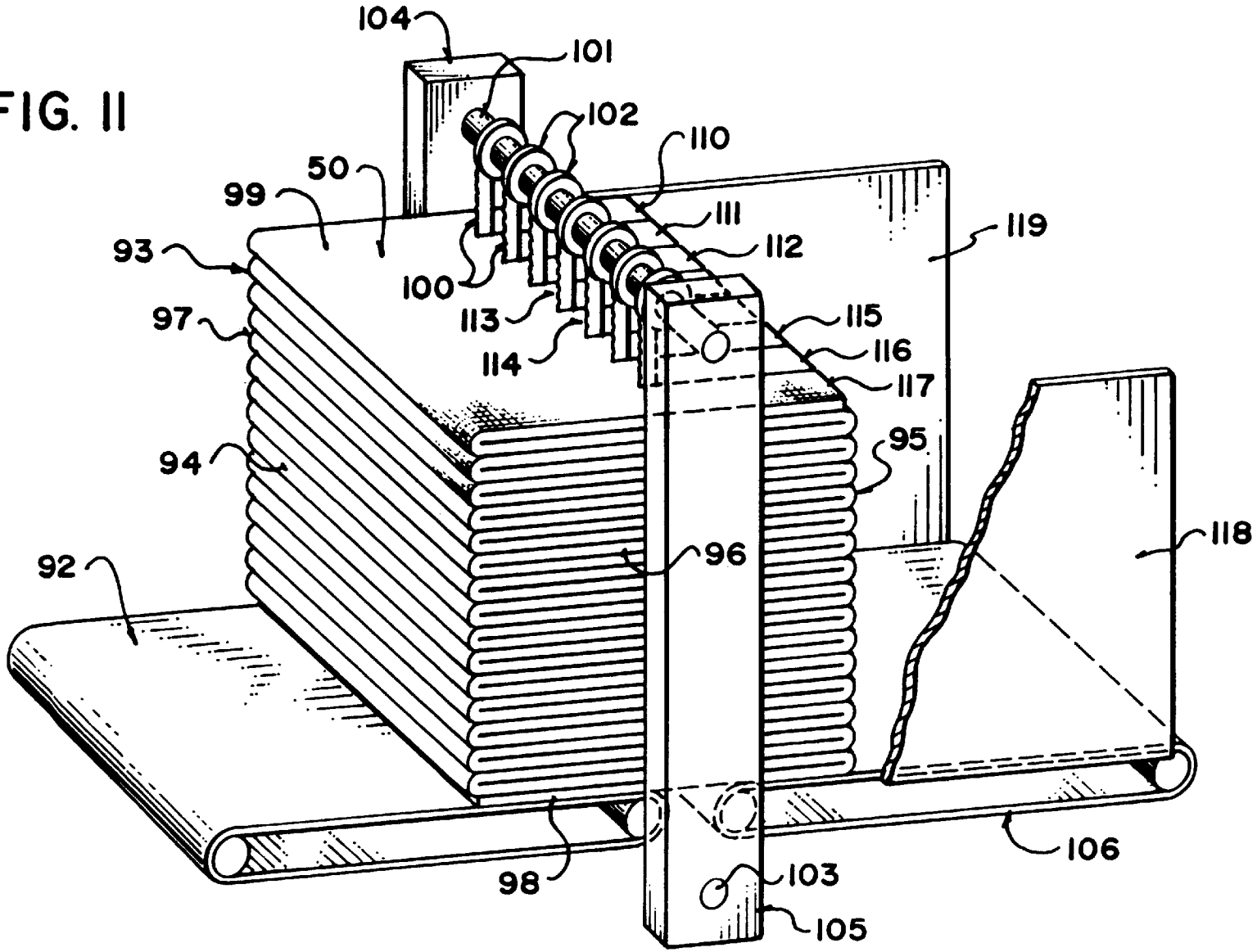
FIG. 11 is an isometric view showing a step in an alternative method for forming a package according to the present invention.

A modified method for manufacturing the package of the structure as shown in FIGS. 1 through 4 uses basically the steps shown in FIGS. 5, 6, 9 and 10 but instead of using the slitter bar 55 of FIGS. 5 and 6 uses the cutting method shown in FIG. 11.

Thus the slitter 55 of FIGS. 5 and 6 is removed and the arrangement as shown in those figures operated to effect a folding action of the complete web without slitting. The web is thus folded back and forth as shown to form a rectangular block of the web.

The body formed by the folded web is then transferred from the table 60 onto a belt conveyor 92. The body 93 has the web 50 folded back and forth as shown so as to form on the body ends 94 and 95 containing the fold lines of the web together with sides 96 and 97 which contain the overlying side edges of the portions of the web. A lowermost web portion 98 is at the bottom of the body and an uppermost web portion 99 is at the top of the body.

A cutting assembly for the body comprises a plurality of band saw blades 100 arranged at spaced positions along a shaft 101. The band saw blades are each mounted on a respective one of a plurality of pulleys 102 so that rotation of the shaft drives the band saw blade along its length. The band saw blades are arranged to stand vertically in parallel vertical planes parallel to the sides 96 and 97 of the body. Each band saw 101 has an idler pulley mounted on a shaft 103 underneath the body and at the discharge end of the conveyor 92. The shafts 103 and 101 are mounted on two parallel support towers 104 and 105 at respective sides of the body. A second conveyor 106 is arranged with an upper run lying in a common horizontal plans with the upper run of the conveyor 92 so as to carry the body through the cutting assembly from an initial uncut position on top of the conveyor 92 to a second position on top of a conveyor 106 in which the body has been cut by the band saws to separate the body into a plurality of parallel layers 110 through 115 which are in effect of the same construction as the layers 80 through 87 of the arrangement shown in FIGS. 5 and 6. Two side guide walls 118 and 119 seen in FIG. 11 are provided for engaging the sides 96 and 97 of the body after cutting to maintain the integrity of the body as it is carried through the cutting station and after cutting is complete while the body is standing on the conveyor 106.

The band saw is of a type known as a razor knife band which is intended to effect a cutting action without removing material from the body as the cutting occurs. The razor knife band is of a type having a scalloped front edge chamfered on both sides of the front edge. The fact that the material can be slightly distorted allows the band blade to slide through the material without removing material from the body. The blade is arranged so that it can accommodate the significant length between the shafts 101 and 103 without significantly distorting from the straight line therebetween. An increased width of the blade may therefore be necessary in view of the relatively long length of the blade to provide a cutting action of up to four feet of the height of the body.

Subsequent to the cutting action, the splicing arrangement shown in FIGS. 9 and 10 is effected to connect the layers 110 through 115 in a similar manner to that of the layers 80 through 87. During the splicing action, the body is carried in a pair of clamping plates on a clamping system similar to the arrangement 74 in FIGS. 9 and 10. The splicing, compressing, bagging and sealing steps are therefore substantially the same as previously described.

The individual layers for a package structure of this type can therefore be formed in different ways and can be assembled into a package structure, following which the splicing is effected to connect the strip of the layers into a continuous length from a leading end of the package to a trailing end of the package.

The technique using the cutting action through the body is particularly effective in that it ensures that the layers are entirely separate without any interleaving and allows the folding action to be effected more rapidly.

The previous splicing arrangement shown in FIGS. 9 and 10 is suitable for packages where the layers are relatively large and the strip is relatively narrow. In such an arrangement, the strip has sufficient stiffness to remain predominantly vertical when the layer is turned horizontal.

Figure 12:
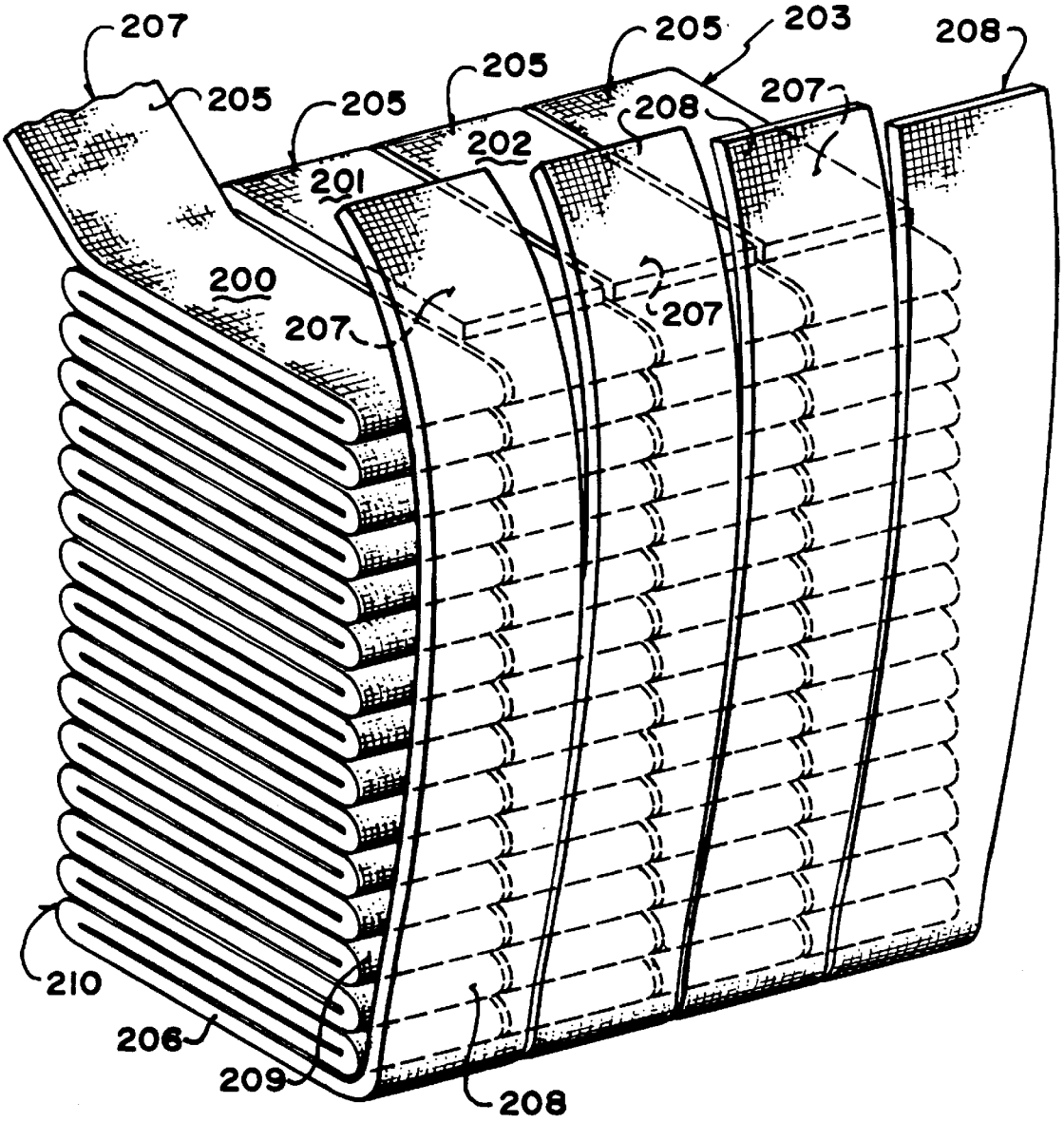
FIG. 12 is a schematic isometric view of a further package structure prepared for splicing of bottom tails to top leads.
Figure 13:
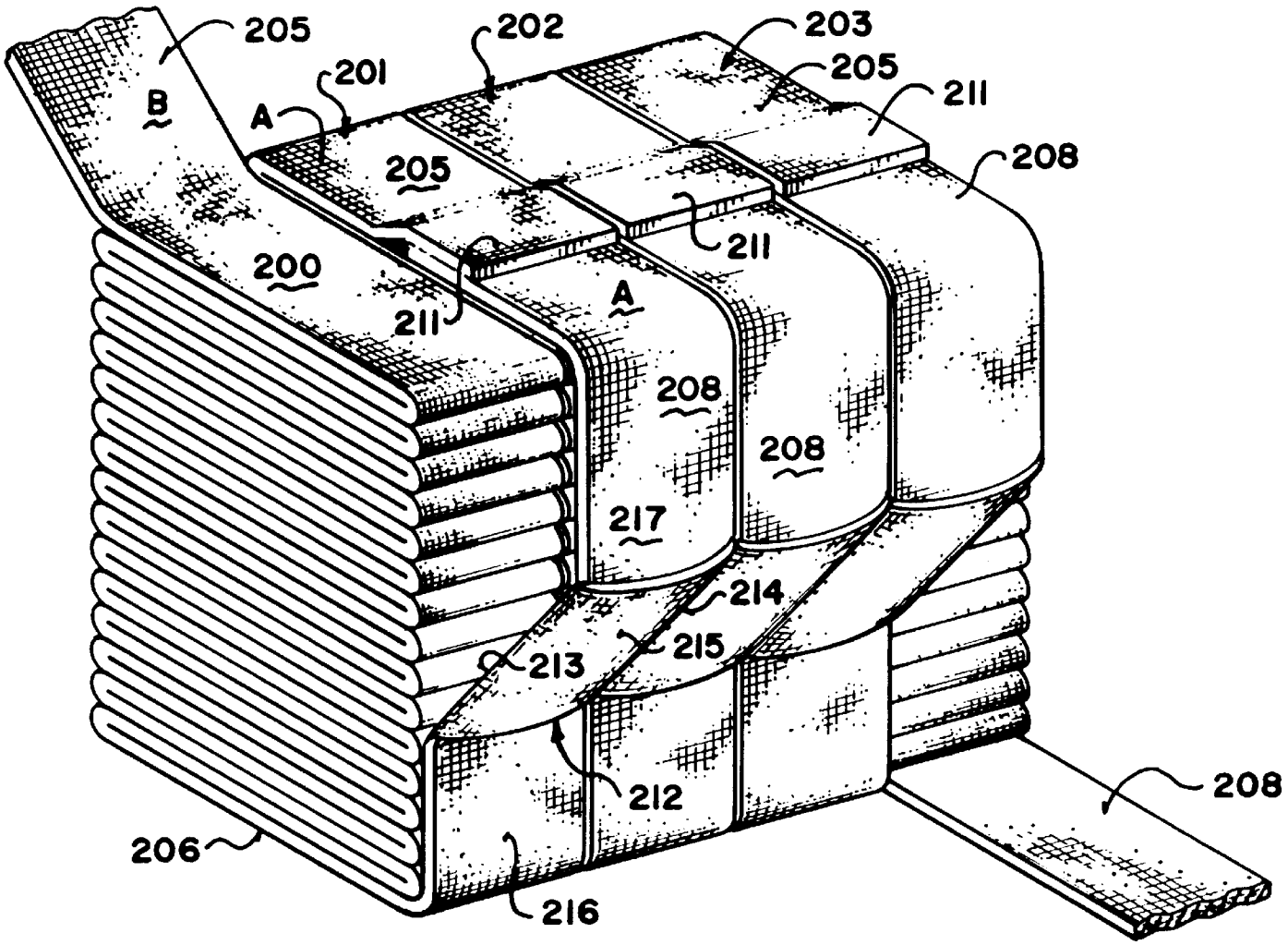
FIG. 13 is a schematic isometric view similar to that of FIG. 12 showing the package after the splices are completed.

Turning now to FIGS. 12 and 13 there is shown a splicing arrangement for use with packages of a strip material of a character which prevents the strip from being turned so that the layers are horizontal as shown in FIG. 3. Such a strip may be relatively wide, may have varying width or may be very thin so that it is not self supporting. Such strips may topple or collapse when turned on edge and the strip portions may become entangled.

It is necessary therefore in such strip forms that the package be oriented so that the layers remain vertical. In this orientation as shown in FIGS. 12 and 13, the layers 200, 201, 202 and 203 are all vertical and side by side so that the individual folded strip portions are horizontal from a horizontal top strip portion 106 of each of the layers to a horizontal bottom strip portion 206 of each of the layers. It is appreciated therefore that in this arrangement each layer will necessarily be unwrapped from the top strip portion down to the bottom strip portion.

The layers are formed as previously described using one or other of the methods as described. Four layers are shown but it will be of course be appreciated that more or less layers can be used.

As shown in FIG. 12, the top end strip portion 205 generally lays across the top of the layer and has an end 207 located on top of the layer. The end portion 205 of the layer 200 is pulled out to define a leading end for the package for attachment to a supply for an end use machine.

The bottom strip portion 206 includes a tail portion 208 which is pulled out from underneath the layer or is formed prior to the formation of the layer as a piece of the strip which hangs out from or beyond one side 109 of the package. The side 209 contains the fold lines of the layer with an opposite side 210 containing the opposite fold lines of the layer.

In some types of material and in some processes, it may be desirable to wrap the package structure as shown in FIG. 12 with the tails 208 not yet connected or spliced and simply free at the top of the packaging material for splicing after transportation and storage is completed. It will be appreciated that the package structure is stationary and therefore readily available for leisurely splicing when it has been moved to the machine to be supplied. Splicing can therefore be effected after the transportation and while the package is awaiting unwrapping or even while the first layer 200 is being unwrapped. The positioning of the tails 208 upwardly along the side of the package to a position at the top of the package makes the tails readily available so that the packaging material previously described can remain in place with simply the top portion of the packaging material opened or removed to allow access to the top portions 205 and the top end of the tail portions 208.

As shown all of the tail portions are arranged at one side 209 of the package. Alternate ones of the tail portions are arranged at opposite sides 209 and 210 so that for example the tail portions 208 of the layers 201 and 203 are arranged at the side 210.

As shown in FIG. 13, the tail portions 208 are spliced to the top portions 205 by a splice 211. As the splice can be done without high speed action necessary, effective splicing systems can be used including stitching and heat sealing which take more time than is generally available on a running line.

The splicing is effected such that the surface A of each strip is attached to the surface A of the strip of the next adjacent layer and similarly the surfaces B are also connected. In some cases this may not be essential to the processing of the strip but in general this is a preferred arrangement to ensure that the strip is supplied in a consistent manner and to avoid twisting of the strip.

In order to ensure that the strip remains without twist, it is necessary to twist the tail portion 208 in a direction which counters the twist which is introduced into the strip as it transfers from layer 200 to layer 101. Careful analysis of the strips and the process of unwrapping will show that the transfer from one layer to the next automatically introduces one turn of twist. It is necessary therefore to counter this turn of twist by a single turn 212 of twist applied to the tail portion prior to splicing at the splice 211. Preferable this turn of twist is applied at a first fold line 213 and a second fold line 214. The first fold line 213 is aligned with the layer 200 and is arranged at an angle of 45° to the horizontal. This forms a horizontal portion 215 of the tail portion which extends from the fold line 213 to the fold line 214 and is therefore in effect horizontal and at right angles to the normal vertical direction of the tail portion 208. The first fold line 213 causes the horizontal portion 215 to lie outside of the vertical portion 216 of the tail portion 208. The second fold line 214 is arranged so that the vertical portion 217 of the tail portion 208 is inside the horizontal portion 215. This arrangement introduces one turn of twist while minimising the length of the horizontal portion 215 and providing a tidy arrangement which is aesthetically attractive and which limits the loose parts available of the tail portion 208 which could otherwise interfere and inter-entangle.

The vertical portion 217 of the tail portion 208 then extends vertically up the layer 201 following which the tail portion 208 extends across the top of the layer 201 to the splice 211.

The horizontal portion 215 is preferable arranged at or immediately adjacent the bottom portion 206 so that almost all of the tail portion 108 is supported by the layer 201 as the layer 200 is withdrawn. There is therefore little or no possibility for the tail portion 208 becoming entangled with the strip from the layer 200 as it is withdrawn and prior to the transfer from the bottom portion 206 through the tail 208 to the top portion 205 of the layer 201.

It is possible to locate alternate ones of the tail portions at the side 210 of the package structure. In such an arrangement it is preferred to include the twists 112 in the tail portions. However theoretically it is possible to omit these twists and to connect the tail portions in straight manner to the top portion of a next adjacent layer. When the tail portions are connected without twist, the automatic twisting effect caused by the transfer of unwrapping from one layer to the next causes the introduction of a twist into the strip. That twist is then cancelled by a twist in the opposite direction at the next transfer position. Such an arrangement may be accommodated in certain circumstances with particular types of strip materials and particular end use machines but this arrangement is clearly not preferred.

The tail portion 208 is folded so that extends up the side 209 to a position above the height of the top portion 205 and is therefore arranged for splicing to the top portion 205 of the next adjacent layer. Alternatively, the twist and the horizontal portion can be located on top of the top portion of the next adjacent layer.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A package comprising:

a plurality of stacks of strip material, each stack formed of a strip of material having a first side edge, a second side edge, a first surface and a second surface;

each stack comprising a plurality of folded portions of the strip, with each portion of the respective stack being folded relative to a next portion about a fold line transverse to the strip;

such that the first surface of each portion lies directly in contact with the first surface of a next adjacent portion and the second surface of each portion lies directly in contact with the second surface of a next adjacent portion;

such that the first side edges of the portions are aligned and also the second side edges of the portions are aligned;

wherein the plurality of stacks of the strip are arranged parallel and side by side without intervening rigid container walls thus defining at least first and second adjacent stacks;

the strip being continuous through each stack from a first end portion of the strip at one end of the stack to a second end portion of the strip at an opposed end of the stack such that a full extent of the strip from the first end portion to the second end portion can be unfolded from the stack by pulling the strip from either end portion;

one end portion of the strip of the first stack forming a first end of the package for supply to an end use machine and one end portion of the strip of the second stack forming a second end of the package for connection to a further package;

the first end portion of the strip of one stack being connected by a spliced portion to one end portion of the strip of an adjacent stack;

such that the strip is continuous through the package and such that a full extent of the strip from the first end portion of said first stack to said one end portion of said second stack can be unfolded for supply to an end use machine.

2. The package according to claim 1 wherein the plurality of stacks include an intermediate stack and a first end portion of the strip of each intermediate stack is connected by said spliced portion to the first end portion of the strip of the next adjacent stack disposed on one side of the intermediate stack and the second end portion of the strip of each intermediate stack is connected by said spliced portion to the end portion of the next adjacent stack disposed on the other side of the intermediate stack.

3. The package according to claim 1 wherein the first end portion of the strip of each stack is coplanar with and connected to the first end portion of the strip of the next adjacent stack by a coplanar first traverse portion containing said spliced portion and extending diagonally across the stacks and the second end portion of the strip of each stack is coplanar with and connected to the second end portion of a next adjacent stack by a second coplanar traverse portion containing said spliced portion and extending diagonally across the stacks.

4. The package according to claim 3 wherein the package is oriented for unwrapping such that the stacks are horizontal and such that the first end of the package is provided by an uppermost one of the stacks and the second end of the package is provided by a bottom one of the stacks and such that the end portions of the stacks lie in vertical planes.

5. The package according to claim 1 wherein the first end portion is connected to said one end portion such that the first surface of the strip of said first end portion is connected to the first surface of the strip of said one end portion and the second surface of the strip of said first end portion is connected to the second surface of the strip of said one end portion.

6. The package according to claim 1 wherein the first end portion is connected to said one end portion such that, when the strip is unwrapped and unwrapping transfers from one stack to the next adjacent stack, no twist is applied to the strip.

7. The package according to claim 1 wherein the stacks are oriented such that the second end portions are horizontal and at a bottom of the stack and the first end portions are horizontal and at a top of the stack and such that the fold lines of the stacks lie substantially in two planes defining sides of the package; wherein the horizontal second end portion of each stack is connected to a horizontal first end portion of a next adjacent stack by a connecting portion which extends along one side of the package outwardly of the fold lines.

8. The package according to claim 7 wherein that part of the strip defined by the connecting portion and the first end portion contains a twist in the strip.

9. The package according to claim 8 wherein the twist is formed by two folds defining a first connecting portion part aligned with one layer and a second connecting portion part aligned with the next adjacent layer.

10. The package according to claim 9 wherein the folds are arranged to form a fold line at an angle to the horizontal.

11. The package according to claim 10 wherein the fold lines are at an angle of about 45 degrees such that a connecting portion extending from said one stack to said next adjacent stack is substantially horizontal and of minimum length.

12. A method of forming a package of a strip comprising:

providing a strip having a first side edge, a second side edge, a first surface and a second surface;

forming a plurality of stacks of the strip;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack, with the strip of each stack continuous through the stack between a bottom strip portion and a top strip portion;

arranging the plurality of stacks side by side with the side edges of the strip portions of each stack adjacent the side edges of a next adjacent stack without intervening rigid container walls; and splicing an end of the strip from each stack to an end of the strip of the next adjacent stack by a splice portion of the strip so as to form a strip that is continuous along its length through the package.

13. The method according to claim 12 wherein the method includes connecting the bottom strip portion of at least one of the stacks to the top strip portion of a next adjacent stack by said splice portion which extends along one end of said at least one of the stacks outwardly of the fold lines thereof.

14. The method according to claim 13 wherein the method includes providing a twist in the strip in a part of the strip defined by the splice portion and the top strip portion.

15. The method according to claim 13 wherein the method includes arranging the splice portions of alternate layers at opposed ends of the stacks and arranging each splice portion to connect between the bottom strip portion of one stack and the top strip portion of the next stack in a straight manner so as to be free from a twist.

16. The method according to claim 13 wherein the method includes placing the entire top surface and the entire bottom surface of each of the stacks under compression in a direction at right angles to the top surface and the bottom surface of the stacks and engaging the package by a packaging material which maintains the compression.

17. The method according to claim 16 wherein the method includes forming the packaging material to define a closed bag surrounding the package, withdrawing air from the bag and sealing the bag against ingress of air.

18. The method according to claim 13 wherein the method includes connecting the top strip portion of one stack by said splice portion to the top strip portion of a next adjacent stack and connecting the bottom strip portion of said one stack by said splice portion to the bottom strip portion of a second next adjacent stack.

19. The method according to claim 13 wherein the method includes connecting the strip from each stack to the next adjacent stack by a splice portion of the strip such that the first surface of the strip is connected to the first surface of the strip and the second surface of the strip is connected to the second surface of the strip.

20. A method of forming a package of a strip comprising:

providing a strip having a first side edge, a second side edge, a first surface and a second surface;

forming a plurality of stacks of the strip;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack, with the strip of each stack continuous through the stack between a bottom strip portion and a top strip portion;

arranging the plurality of stacks side by side with the side edges of the strip portions of each stack adjacent the side edges of a next adjacent stack without intervening rigid container walls thus defining a first side stack and a second side stack and a plurality of intermediate stacks and defining for each intermediate stack a first next adjacent stack on one side and a second next adjacent stack on an opposed side;

arranging one of the top and bottom strip portions of the first side stack to form a leading end of the package for supply to an end use machine and one of the top and bottom strip portions of the second side stack to form a trailing end of the package for connection to a further package;

splicing an end of the bottom strip portion of the strip of each intermediate stack by a splice portion to an end of one of the top and bottom strip portions of the first next adjacent stack and splicing an end of the top strip portion of the strip of each intermediate layer by a splice portion to an end of one of the top and bottom strip portions of the second next adjacent stack so as to form a strip that is continuous though the package; and securing the stacks together by packaging material in a single package.

21. The method according to claim 20 wherein the method includes connecting the bottom strip portion of each stack, except the second side stack, to the top strip portion of a next adjacent stack by said splice portion which extends along one end of said each stack outwardly of the fold lines thereof.

22. The method according to claim 21 wherein the method includes providing a twist in the strip in a part of the strip defined by the splice portion and the top strip portion.

23. The method according to claim 21 wherein the method includes arranging the splice portions of alternate layers at opposed ends of the stacks and arranging each splice portion to connect between the bottom strip portion of one stack and the top strip portion of the next stack in a straight manner so as to be free from a twist.

24. The method according to claim 20 wherein the method includes placing the entire top surface and the entire bottom surface of each of the stacks under compression in a direction at right angles to the top surface and the bottom surface of the stacks and engaging the package by the packaging material which maintains the compression.

25. The method according to claim 20 wherein the method includes connecting the top strip portion of one stack by said splice portion to the top strip portion of a next adjacent stack and connecting the bottom strip portion of said one stack by said splice portion to the bottom strip portion of a second next adjacent stack.

26. The method according to claim 20 wherein the method includes connecting the strip from each stack to the next adjacent stack by a splice portion of the strip such that the first surface of the strip is connected to the first surface of the strip and the second surface of the strip is connected to the second surface of the strip.

27. A method of forming a package of a strip comprising:

providing a strip having a first side edge, a second side edge, a first surface and a second surface;

forming a plurality of stacks of the strip;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack, with the strip of each stack continuous through the stack between a bottom strip portion and a top strip portion;

arranging the plurality of stacks side by side with the side edges of the strip portions of each stack adjacent the side edges of a next adjacent stack without intervening rigid container walls; and providing for each of the stacks a splice tail portion of the strip extending from the bottom strip portion and extending beyond an end of the stack so as to be accessible for splicing.

28. The method according to claim 27 wherein the method includes arranging the splice tail portions of alternate layers at opposed ends of the stacks.

29. The method according to claim 27 wherein the method includes placing the entire top surface and the entire bottom surface of each of the stacks under compression in a direction at right angles to the top surface and the bottom surface of the stacks and engaging the package by a packaging material which maintains the compression.

30. The method according to claim 29 wherein the method includes forming the packaging material to define a closed bag surrounding the package, withdrawing air from the bag and sealing the bag against ingress of air.

31. A method of forming a package of a strip comprising:

providing a strip having a first side edge, a second side edge, a first surface and a second surface;

forming a plurality of stacks of the strip;

in each said stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions to form a plurality of first fold lines at one end of each stack and a plurality of second fold lines at an opposed end of each stack;

arranging the strip portions such that the first surface of each strip portion lies directly in contact with the first surface of one next adjacent strip portion and such that the second surface of each strip portion lies directly in contact with the second surface of the other next adjacent strip portion;

arranging the strip portions with the first side edges thereof lying directly on top of and aligned with the first side edges of others of the strip portions of each stack and with the second side edges thereof lying directly on top of and aligned with the second side edges of others of the strip portions;

arranging the strip portions of each stack with the first and second surfaces thereof generally parallel to a top surface and bottom surface of each stack with the strip continuous through the respective stack between a bottom strip portion and a top strip portion;

providing for each the stack a splice tail portion of the strip extending from the bottom strip portion and extending beyond an end of the respective stack so as to be accessible for splicing;

applying external compressive force so as to place the entire top surface and the entire bottom surface of each stack under compression in a direction at right angles to the top surface and the bottom surface of the stack; and engaging the package by a packaging material which maintains the compression.

32. The method according to claim 31 wherein the method includes forming the packaging material to define a closed bag surrounding the package, withdrawing air from the bag and sealing the bag against ingress of air.

33. The method of claim 12, including the step of securing the stacks together by packaging material in a single package.

34. The method of claim 12 wherein the side edges of the strip portions of each stack directly contact the side edges of a next adjacent stack.

35. The method of claim 12 including the step of arranging the plurality of stacks such that the strip of each stack has the side edges thereof along the complete length of the strip unattached from the side edges of the strip of a next adjacent stack.

36. The method of claim 12 including the step of forming the strip of each stack by longitudinally slitting a web such that each side edge of the strip is a slit edge completely separated from the strip of a next adjacent stack.

37. The method of claim 16 wherein the compression applied by said compression applying step is sufficient to reduce the thickness of each strip portion of the stack.

38. The method of claim 37 wherein the strip is fibrous.

39. The method of claim 20 wherein the side edges of the strip portions of each stack directly contact the side edges of a next adjacent stack.

40. The method of claim 27 including the step of forming the strip of each stack by longitudinally slitting a web such that each side edge of the strip is a slit edge completely separated from the strip of a next adjacent stack.

41. The method of claim 27 including the step of arranging the plurality of stacks such that the strip of each stack has the side edges thereof along the complete length of the strip unattached from the side edges of the strip of a next adjacent stack.

42. The method of claim 27 wherein the side edges of the strip portions of each stack substantially directly contact the side edges of a next adjacent stack.

43. The method of claim 27 including the step of securing the stacks together by packaging material in a single package.

44. The method of claim 29 wherein the compression applied by said compression applying step is sufficient to reduce the thickness of each strip portion of said stack.

45. The method of claim 44 wherein the strip is fibrous.

46. The method of claim 31 wherein the compression applied by said compression applying step is sufficient to reduce the thickness of each strip portion of the stack.

47. The method of claim 31 wherein the strip is fibrous.

48. A method of forming a package of a strip comprising:

providing a strip having a first side edge, a second side edge, a first surface and a second surface;

forming at least three stacks of the strip;

in each stack repeatedly folding the strip back and forth with the strip continuous through the stack between a bottom strip portion and a top strip portion so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack thus to form a plurality of first fold lines at one end of the stack and a plurality of second fold lines at an opposed end of the stack;

arranging the strip portions of each stack thus such that the first surface of each strip portion lies directly in contact with the first surface of one next adjacent portion and such that the second surface of each portion lies directly in contact with the second surface of the other next adjacent portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack;

arranging the plurality of stacks side by side; and splicing an end of the strip from each stack to an end of the next adjacent stack by a splice portion of the strip so as to form a strip that is continuous through the package and such that there is no accumulated twist in the strip when said three stacks are unfolded.

49. The method of claim 48 wherein the step of splicing so that there is no accumulated twist includes splicing the bottom strip portion of at least one of the stacks to the top strip portion of a next adjacent stack by said splice portion which extends along one end of the stacks outwardly of the fold lines thereof and providing a twist in a part of the strip defined by the splice portion and the top strip portion.

50. The method of claim 48 wherein the step of splicing so that there is no accumulated twist includes splicing the bottom strip portion of at least one of the stacks to the top strip portion of a next adjacent stack by said splice portion which extends along one end of the stacks outwardly of the fold lines thereof and arranging the splice portions of alternate stacks at opposed ends of the stacks.

51. The method of claim 50 wherein each splice portion is arranged to connect between the bottom strip portion of one stack and the top strip portion of the next stack without a twist.

52. The method of claim 48 including the step of securing the stacks together by packaging material in a single package.

53. The method of claim 48 wherein the side edges of the strip portions of each stack are adjacent the side edges of a next adjacent stack without intervening rigid container walls.

54. The method of claim 53 wherein the side edges of the strip portions of each stack substantially directly contact the side edges of a next adjacent stack.

55. The method of claim 48 including the step of arranging the plurality of stacks such that the strip of each stack has the side edges thereof along the complete length of the strip unattached from the side edges of the strip of a next adjacent stack.

56. The method of claim 48 including the step of forming the strip of each stack by longitudinally slitting a web such that each side edge of the strip is a slit edge completely separated from the strip of a next adjacent stack.

57. The method of claim 48 wherein the entire top surface and the entire bottom surface of each of the stacks is under compression in a direction at right angles to the top surface and the bottom surface of the stacks and the package is engaged by a packaging material which maintains the compression.

58. The method of claim 57 wherein the packaging material comprises a closed bag surrounding the package from which air has been withdrawn and which is sealed against ingress of air.

59. The method of claim 57 wherein the compression applied by said compression applying step is sufficient to reduce the thickness of each strip portion of said stack.

60. The method of claim 59 wherein the strip is fibrous.

61. A method of forming a package of a strip comprising:

providing a strip having a first side edge, a second side edge, a first surface and a second surface;

forming a plurality of stacks of the strip;

in each stack repeatedly folding the strip back and forth with the strip continuous through the stack between a bottom strip portion and a top strip portion so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack thus to form a plurality of first fold lines at one end of the stack and a plurality of second fold lines at an opposed end of the stack;

arranging the strip portions of each stack thus such that the first surface of each strip portion lies directly in contact with the first surface of one next adjacent portion and such that the second surface of each portion lies directly in contact with the second surface of the other next adjacent portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack;

arranging the plurality of stacks side by side with the side edges of the strip portions of each stack adjacent the side edges of a next adjacent stack without intervening rigid container walls and such that the strip of each stack has the side edges thereof along the complete length of the strip unattached from the side edges of the strip of a next adjacent stack.

62. The method of claim 61 including the step of securing the stacks together by packaging material to form a single package.

63. The method of claim 61 wherein the side edges of the strip portions of each stack substantially directly contact the side edges of a next adjacent stack.

64. The method of claim 61 including the step of arranging the strip of each stack by longitudinally slitting a web such that each side edge of the strip is a slit edge completely separated from the strip of a next adjacent stack.

65. The method of claim 61 wherein the entire top surface and the entire bottom surface of each of the stacks is placed under compression by an external force in a direction at right angles to the top surface and the bottom surface of the stacks and the package is engaged by a packaging material which maintains the compression.

66. The method of claim 65 wherein the packaging material comprises a closed bag surrounding the package from which air has been withdrawn and which is sealed against ingress of air.

67. The method of claim 65 wherein the compression applied by said compression applying step is sufficient to reduce the thickness of each strip portion of said at least one stack.

68. The method of claim 67 wherein the strip is fibrous.

69. A method of forming a package of a strip comprising:

providing a compressible strip having a first side edge, a second side edge, a first surface and a second surface;

forming a plurality of stacks of the strip;

in each stack repeatedly folding the strip back and forth with the strip continuous through the stack between a bottom strip portion and a top strip portion so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack thus to form a plurality of first fold lines at one end of the stack and a plurality of second fold lines at an opposed end of the stack;

arranging the strip portions of each stack thus such that the first surface of each strip portion lies directly in contact with the first surface of one next adjacent portion and such that the second surface of each portion lies directly in contact with the second surface of the other next adjacent portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the first and second surfaces thereof generally parallel to a top surface and a bottom surface of the stack;

arranging the plurality of stacks side by side with the side edges of the strip portions of each stack adjacent the side edges of a next adjacent stack without intervening rigid container walls;

applying an external compressive force so as to place the entire top surface and the entire bottom surface of each of the stacks under compression in a direction at right angles to the top surface and the bottom surface of the stack;

and engaging the stacks by a packaging material which maintains the compression and holds the stacks together as a single package.

70. The method of claim 69 wherein the side edges of the strip portions of each stack substantially directly contact the side edges of a next adjacent stack.

71. The method of claim 69 wherein the packaging material comprises a closed bag surrounding the package from which air has been withdrawn and which is sealed against ingress of air.

72. The method of claim 69 wherein the compression applied by said compression applying step is sufficient to reduce the thickness of each strip portion of said at least one stack.

73. The method of claim 72 wherein the strip is fibrous.

74. The package according to claim 1 wherein the package is oriented for unwrapping such that the stacks are vertical.

75. The package according to claim 1 wherein the stacks are secured by a packaging material.

76. The package according to claim 75 wherein the packaging material holds the stacks in a compressed state.

77. The package according to claim 1 wherein the spliced portion is arranged at alternate ends of the stacks in the package so that when the continuous strip is removed from the package there is no accumulated twist in the strip.

78. The package according to claim 1 wherein the side edges of the strip in the adjacent stacks are unattached and directly in contact.

79. The package according to claim 1 wherein the strip is fibrous.

80. A package comprising:

a plurality of stacks of strip material, each stack formed of a strip of material having a first side edge, a second side edge, a first surface and a second surface;

each stack comprising a plurality of folded portions of the strip, wherein each portion of the stack is folded relative to the next portion about a line transverse to the strip;

such that the first surface of each portion lies directly in contact with the first surface of a next adjacent portion and the second surface of each portion lies directly in contact with the second surface of a next adjacent portion;

and such that the first side edges of the portions are aligned and also the second side edges of the portions are aligned;

wherein the plurality of stacks of the strip are arranged parallel and side by side without intervening rigid container walls thus defining at least first and second adjacent stacks;

the stacks being oriented such that end portions of the strip in each stack are horizontal and positioned at a bottom of the stack and at a top of the stack, such that the fold lines of the stacks lie substantially in two planes defining sides of the package;

the strip being continuous through each stack from a first end portion of the strip at one end of the stack to a second end portion of the strip at an opposed end of the stack, such that a full extent of the strip from the first end portion to the second end portion can be unfolded from the stack by pulling the strip from the first end portion;

the second end portion of each stack including a tail portion extending from the bottom of the stack, upwardly along a side of the package toward the top of the package for splicing to the first end portion of the next adjacent stack or to a next package.

81. The package according to claim 80 wherein all of the tail portions are arranged at one side of the package.

82. The package according to claim 80 wherein the tail portions of adjacent stacks are arranged at alternating sides of the package.

83. The package according to claim 80 further comprising packaging material secured around stacks of the strip to hold the stacks in a compressed state.

84. The package according to claim 80 wherein the side edges of the strip in the adjacent stacks are unattached and directly in contact.

85. The package according to claim 80 wherein the strip is fibrous.

* * * * *

UNITED STATES PATENT AND TRADEMARK OFFICE

CERTIFICATE OF CORRECTION

PATENT NO. : 5,966,905
DATED : October 19, 1999
INVENTOR(S) : Lawrence J. O'Connor, Mark B Davidson and Darrell Van Mol It is certified that error appears in the above-identified patent and that said Letters Patent is hereby corrected as shown below:

Column 17,
Lines 40, 50 and 55, delete "13" and replace with -- 12 --.

Signed and Sealed this

Fourteenth Day of May, 2002

*Attest:*

*Attesting Officer*

JAMES E. ROGAN
*Director of the United States Patent and Trademark Office*